US006009601A

United States Patent [19]

Kaufman

[11] Patent Number: 6,009,601

[45] Date of Patent: Jan. 4, 2000

[54] MAGNETIC SNAP LOCK

[76] Inventor: Eli Kaufman, 939 51st St., Brooklyn, N.Y. 11219

[21] Appl. No.: 08/868,802

[22] Filed: Jun. 4, 1997

[51] Int. Cl.[7] ..... A44B 17/00; H01F 7/00

[52] U.S. Cl. ..... 24/303; 24/49.1; 24/66.1

[58] Field of Search ..... 24/303, 66.1, 49.1; 248/309.4

[56] References Cited

U.S. PATENT DOCUMENTS

| | | | |
|---|---|---|---|
| 3,111,737 | 11/1963 | Heil | 24/303 |
| 4,480,361 | 11/1984 | Morita | 24/66.1 |
| 4,505,007 | 3/1985 | Aoki | 24/66.1 |
| 5,042,116 | 8/1991 | Ossiani | 24/303 |
| 5,253,394 | 10/1993 | Morita | 24/303 |
| 5,451,082 | 9/1995 | Murai | 24/658 |
| 5,515,581 | 5/1996 | Kaufmann | 24/303 |

*Primary Examiner*—Victor N. Sakran

*Attorney, Agent, or Firm*—Oblon, Spivak, McClelland, Maier & Neustadt, P.C.

[57] ABSTRACT

A magnetic snap lock includes cooperating male and female members. The female member includes an attachment base unit and an attachment part or grommet which includes a tubular projection. The tubular projection permits the attachment of the grommet to the attachment base unit. The female member also includes an actuator assembly which can also be mounted on the attachment base unit. The male member includes a protruding member with a magnet which is insertable into an opening of the attachment part or grommet of the female member to provide for a releasable locking.

24 Claims, 11 Drawing Sheets

10
12c
12b
12a

10

11
12
12c
12b
12a 4
3
4a 6
4
3a
3

6
4
6a
3
40

3a
3
5
6

4
4a
4a
4b
5b
5a
5
6a
6b
6

MAGNETIC SNAP LOCK

BACKGROUND OF THE INVENTION

1. Field of the Invention

The present invention relates to a magnetic snap lock for various types of bags such as handbags, briefcases and backpacks, and for various types of boxes, belts and other types of fasteners used for keeping door-type structures either opened or closed.

2. Discussion of the Related Art

Fastening devices which utilize a combination of interconnecting male and female members and the attractive force of a magnet are advantageous in that they are easy to use. Related fastening devices have drawbacks in that they are difficult to assemble in an efficient and economical manner. Additionally, the related fastening devices have drawbacks in that they are not easily adaptable to fabrics such as cloth or leather of various thicknesses.

SUMMARY OF THE INVENTION

An object of the invention is to provide for a magnetic snap lock device which has a strong closure between the male and female members, while at the same time is easy to assemble.

A further object of the present invention is to provide for a magnetic snap lock which enables a rapid and accurate assembly of the component parts of the device.

A further object of the present invention is to provide a magnetic snap lock in which at least one of the male and female members of the lock is constructed so as to be adaptable to fabrics such as cloth or leather of various thicknesses.

The magnetic snap lock of the present invention comprises a female member that includes an attachment base unit having a first opening; an attachment part having a tubular projection which defines a second opening, the tubular projection extending into the first opening of the attachment base unit; and an actuator assembly mounted on the attachment base unit, the attachment base unit comprising first projecting fixing members for fixing the actuator assembly on the attachment base unit. The magnetic snap lock further comprises a male member that has a protruding member that is insertable in the second opening of the attachment part.

The present invention also relates to a snap lock which comprises a female member. The female member includes an attachment base unit having a central opening and a plurality of projections; an attachment grommet having a tubular extension which extends into the central opening, the tubular extension having an upper portion which is bent onto an inner circumference of the central opening for attaching the attachment grommet to the attachment base unit, wherein a length of the tubular extension and an amount of bending of the upper portion of the tubular extension permits placement of materials of various thicknesses between the attachment grommet and the attachment base unit; and a locking assembly held on the attachment base unit by the plurality of projections. The snap lock further comprises a male member which comprises fastening means for releasably fastening the male member to the female member.

The present invention also relates to a spring attachment base unit for a snap lock. The attachment base unit of the present invention comprises a base plate having an opening with a recessed circumference; at least one upwardly biased spring plate positioned on the base plate; and a plurality of projections extending from the base plate. The plurality of projections comprise a projecting base clip having folded portions, a notch plate, a plurality of substantially L-shaped members, and a plurality of straight members.

BRIEF DESCRIPTION OF THE DRAWINGS

A more complete appreciation of the invention and many of the attendant advantages thereof will be readily obtained as the same becomes better understood by reference to the following detailed description when considered in connection with accompanying drawings, wherein.

DESCRIPTION OF THE PREFERRED EMBODIMENTS

Figure 1:
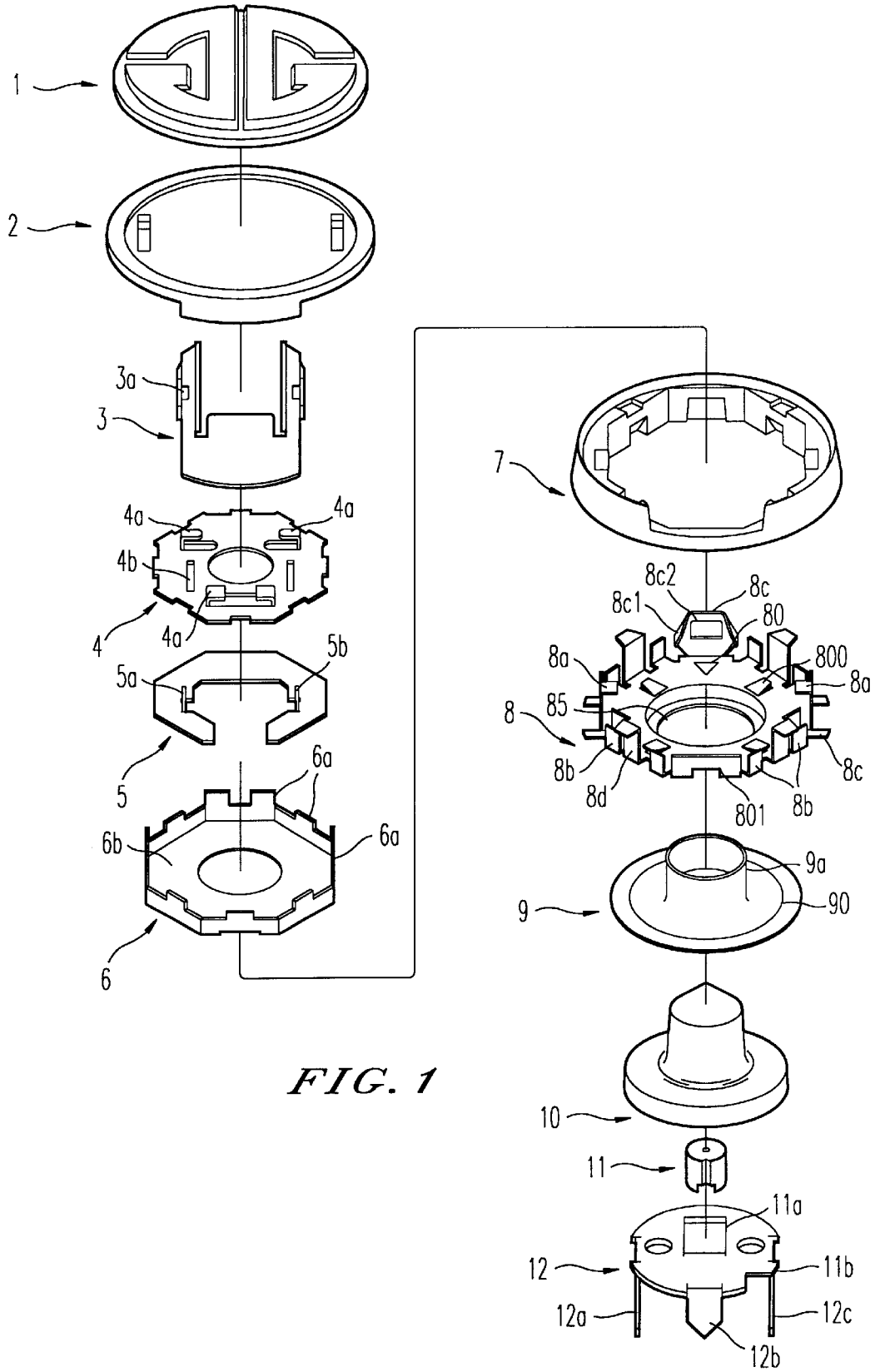
FIG. 1 is an exploded view of the elements of the magnet snap lock of the present invention.

Referring now to the drawings, wherein like reference numerals designate identical or corresponding parts throughout the several views, and more particularly to FIG. 1 thereof, FIG. 1 illustrates an exploded perspective view of the magnetic snap lock of the present invention.

As illustrated in FIG. 1, the female member of the magnetic snap lock includes the components 1–9. The male member includes the components 10–12.

Referring now to the female member, the female member includes a spring attachment base unit 8 which includes first projecting portions 8*b* which can be straight. The attachment base unit 8 further includes a projecting clip portion 8*c* that comprises folded over portions 8*c*'. The attachment base unit 8 also includes further projecting portions 8*d* which can be L-shaped and 8*e* which can be straight. The projections 8*a*, 8*b*, 8*d* and 8*e* and the clip portion 8*c* can be integral with the attachment base unit 8. The attachment base unit 8 also includes upwardly biased spring type levers or plates 800, an upwardly extending notch 801 and downwardly extending teeth 80.

The female member further includes an attachment part or grommet 9 which has a tubular extension 9*a* and a base 90. The tubular extension 9*a* is sized so as to be insertable through an opening 85 in the attachment base unit 8.

The female member further includes an actuator assembly which includes the components 3, 4, 5 and 6. Component 6 is a housing base into which is slidably fitted a locking slide bar 5. Component 4 is a cover plate onto which is fitted an actuator.

The housing base 6 includes upwardly extending walls that include upward projections 6*a*. The locking slide bar 5 which is fittable within the base 6*b* of the housing base 6 can be C-shaped and includes upwardly extending projections 5*a* and a locking surface 5*b*. It is noted that the specific shape of the locking slide bar depends on design considerations.

The cover plate 4 includes bent over projections 4*a* and slots 4*b*. The positioning of the slots 4*b* of the cover plate 4 corresponds to the projections 5*a* of the locking slide bar 5.

Figure 2:
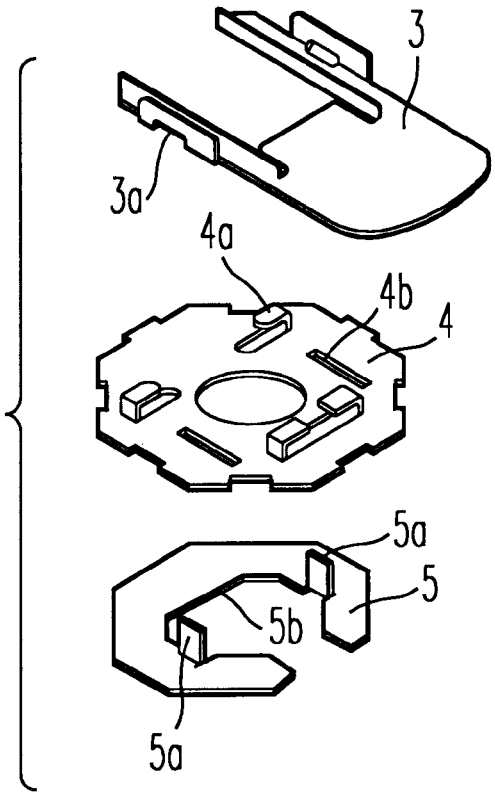
FIG. 2 is an exploded perspective view of certain element FIG. 1.

The actuator 3 includes receiving slot portions 3*a* which are more clearly illustrated in the perspective view of FIG. 2. The receiving slot portions 3*a* correspond to the slots 4*b* of the cover plate 4 and the projections 5*a* of the locking slide bar 5.

The female member further includes a decorative housing ring 7 which can fit around the spring attachment base unit 8, as well as a snap on decorative cover 2 and a snap in decorative insert 1. The snap on decorative cover 2 and snap in decorative insert 1 are fittable onto the decorative housing ring 7.

The attachment part or grommet 9 can be made of a metallic material, while the locking slide bar 5 can be made of a ferromagnetic material. The remaining elements of the male and female members are preferably made of resin or plastic material, however, this is based on design considerations.

Figure 20A:
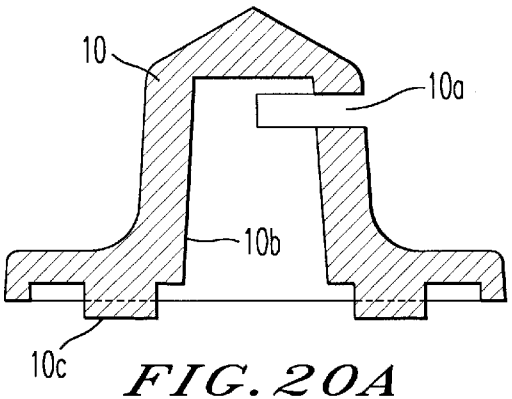
FIGS. 20A–20D illustrate detailed views of the protruding portion of the male member.
Figure 20B:
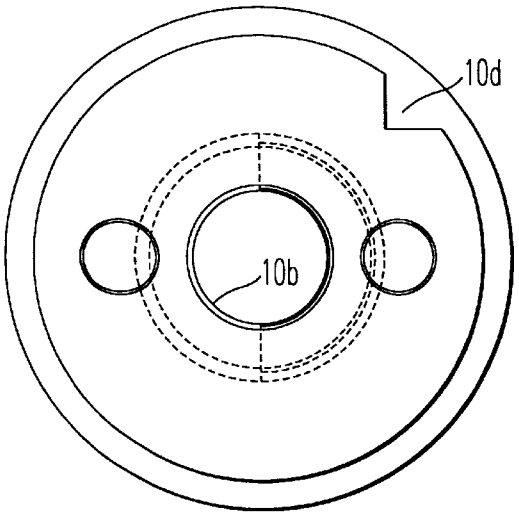
Figure 20C:
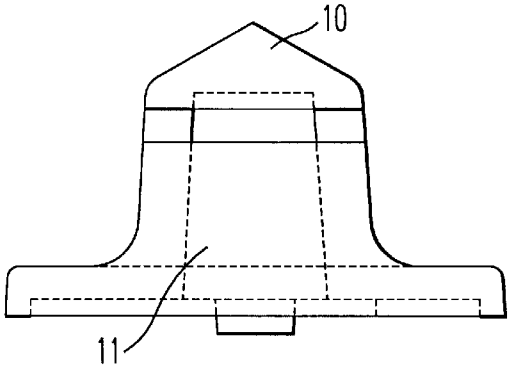
Figure 20D:
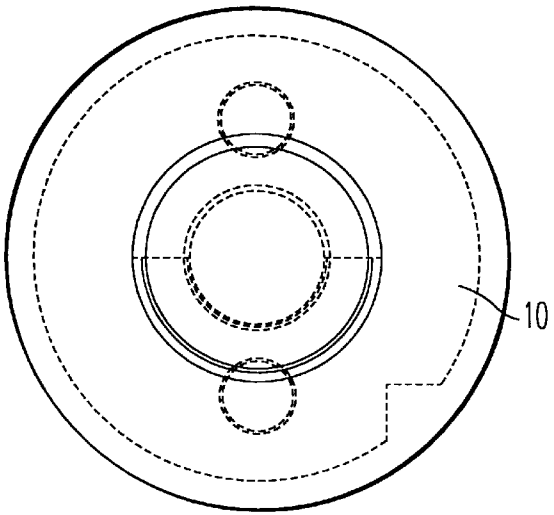
Figure 21:
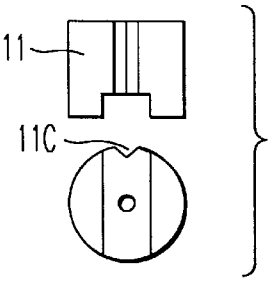
FIG. 21 is a side and bottom view of the magnet.
Figure 22:
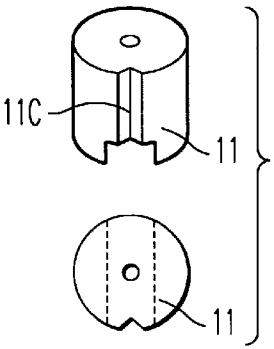
FIG. 22 is a perspective view of the magnet.
Figure 23A:
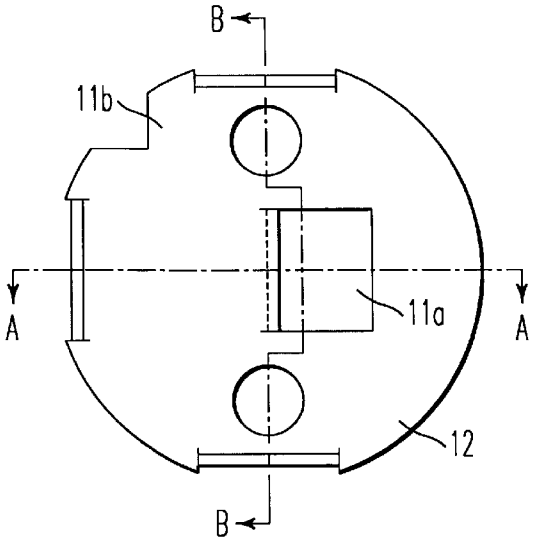
FIGS. 23A–23F are detailed views of the prong plate.
Figure 23B:
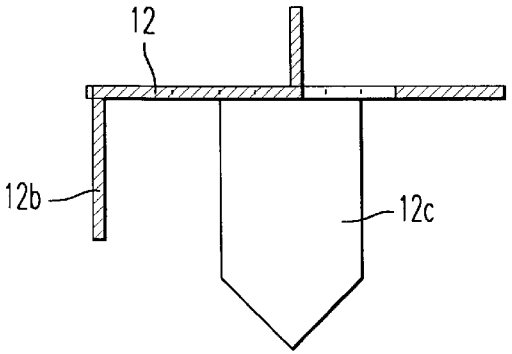
Figure 23C:
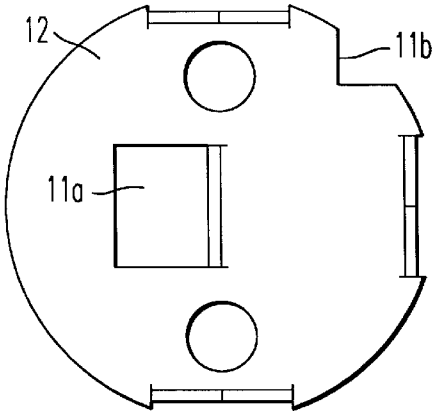
Figure 23D:
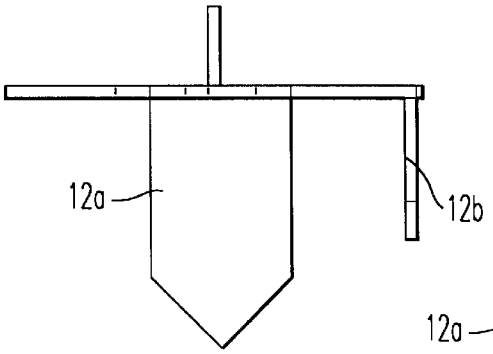
Figure 23E:
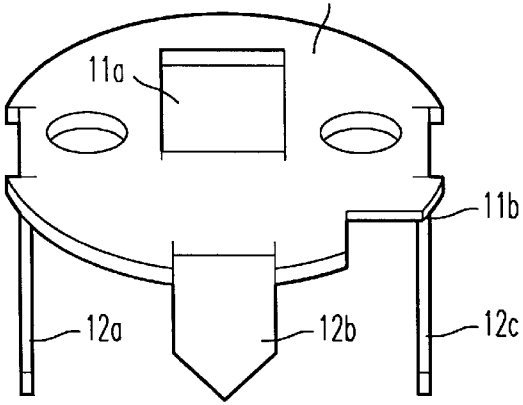
Figure 23F:
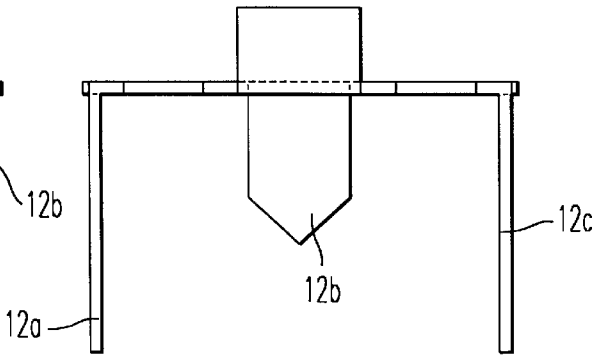
Figure 24A:
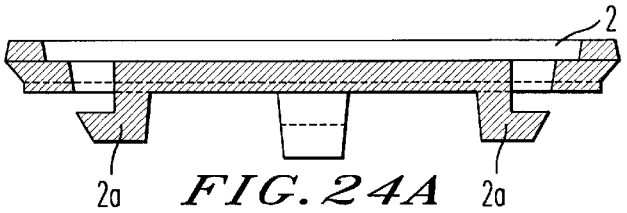
FIGS. 24A–24F are detailed views of the decorative insert.
Figure 24B:
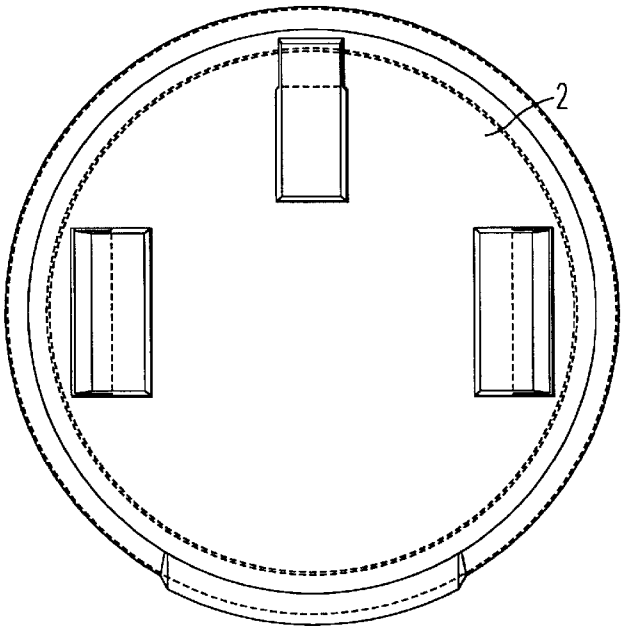
Figure 24C:
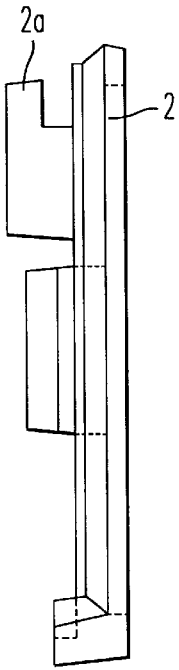
Figure 24D:
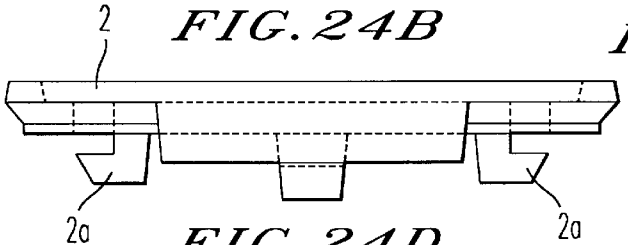
Figure 24E:
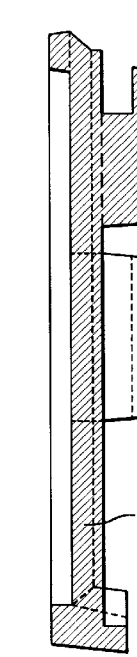
Figure 24F:
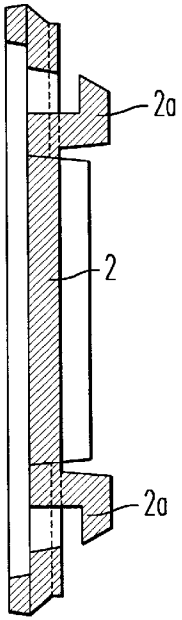

The male member as illustrated in FIG. 1 includes a male part mounting prong plate 12 (see FIGS. 23A–23F) which includes prongs 12*a*, 12*b* and 12*c*, as well as a protruding portion 10 which is attachable onto the prong plate 12. It is noted that the prong 12*b* which is shorter than the prongs 12*a* and 12*c* is an alignment prong which folds over. The prong plate 12 further includes a notch 11*b* which can cooperate with a corresponding member on the bottom of the protruding portion 10. On the surface of the prong plate 12 is positioned a raised portion or base 11*a*. A magnet 11 is positioned on the raised portion or base 11*a* and thereafter positioned within an opening 10*b* in the protruding portion 10 as illustrated in FIGS. 20A and 20C. The protruding portion 10 further includes a slot 10*a* as illustrated in FIGS. 1 and 20A–20D for exposing a portion of the magnet 11, the specifics of which are shown in FIGS. 21–22. As further illustrated in FIGS. 21–22, the magnet 11 includes an alignment slot 11*c*.

Figure 3:
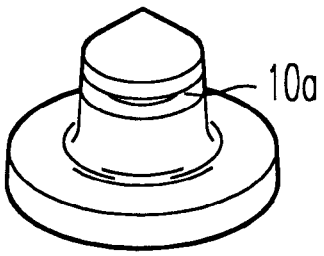
FIG. 3 is a view rotated 180° of element 10 illustrated in FIG. 1.

Also, as illustrated in FIGS. 20A–20D, the protruding member 10 can include mounting portions 10*c* as well as an alignment slot 10*d*. The protruding portion 10 further includes a slot 10*a* for exposing a portion of the magnet 11. The slot 10*a* is illustrated in FIG. 3 which is a view of the magnet 11 rotated 180°.

Detailed views of the mounting prong plate 12 are illustrated in FIGS. 23A–23F. As noted in these figures, the mounting prong plate 12 includes the prongs 12*a*, 12*b* and 12*c*, with the prong 12*b* being shorter than the prongs 12*a*and 12*c*. Each of the prongs are bent from the top surface of the prong 12. As further illustrated in FIGS. 23A–23F, the prong plate 12 includes the raised portion 11*a* for mounting the magnet 11 and the notch 11*b* which cooperates with a corresponding element in the protruding portion 10.

The process of assembling the actuator assembly which includes the elements 3, 4, 5 and 6 will be described with reference to FIGS. 4–5 and 6A–6C and the arrows shown in these figures.

Figures 4, 5, 6A, 6B, 6C, 7A, 7B, 7C:
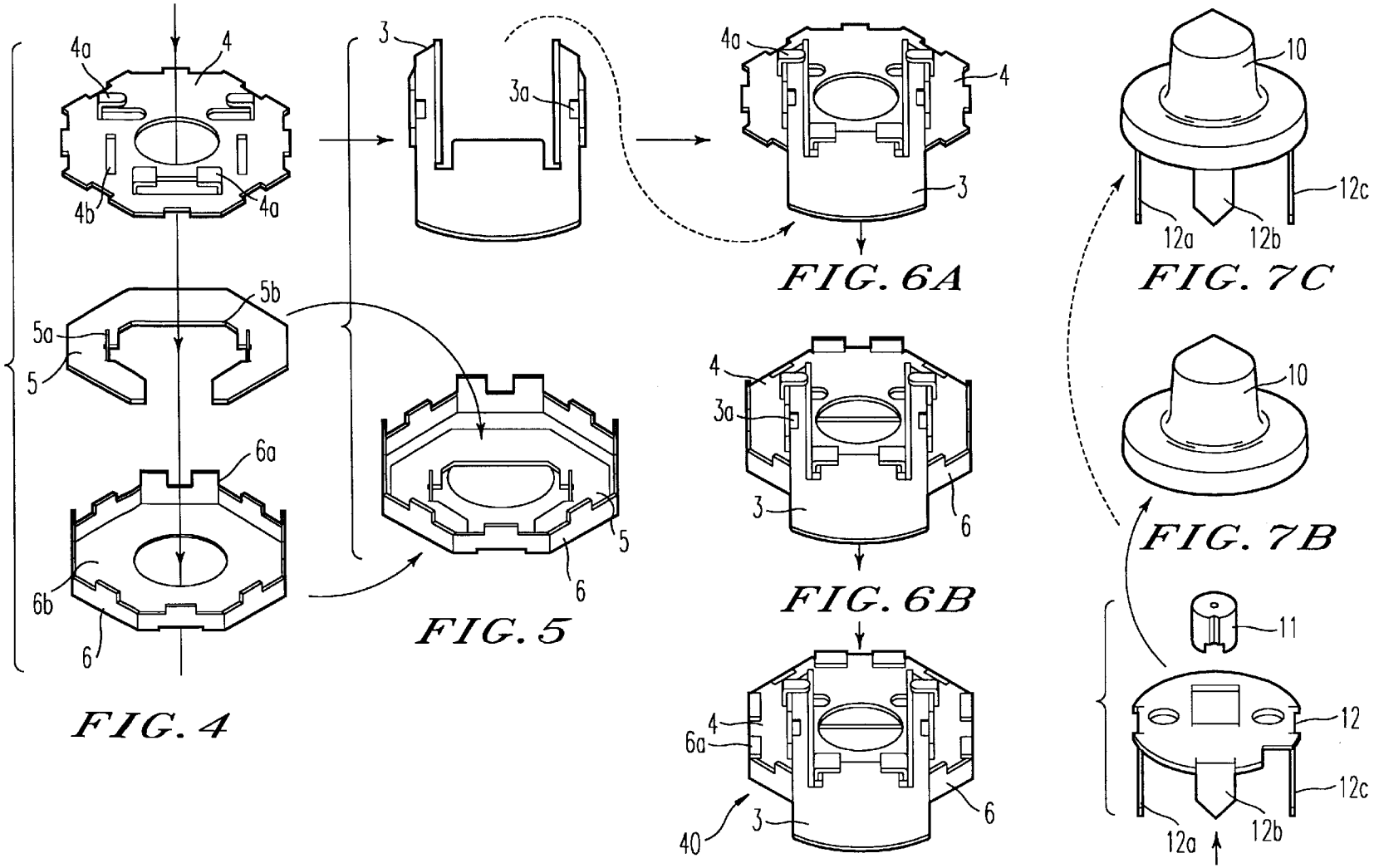
FIG. 4 is an exploded view of elements of the pusher plate assembly of the present invention.
FIG. 5 is a further exploded view of elements of the pusher plate assembly.
FIGS. 6A–6C are sequential views of the assembly of the pusher plate assembly.
FIGS. 7*a*–7*c* are sequential views showing the assembly of elements of the male member.

As illustrated in FIGS. 4–5, the locking slide bar 5 is inserted within the base 6*b* of the housing base 6. As illustrated in FIG. 6A, the actuator 3 is attached to the cover plate 4 by way of the projections 4*a*. The cover plate 4 with the actuator 3 mounted thereon are then assembled onto the housing base unit 6 which includes the locking slide bar 5 positioned therein. The projections 5*a* on the locking slide bar 5 extend through the corresponding slots 4*b* of the cover plate 4 and are received in the receiving slot portions 3*a* of the pusher plate 3. As noted in FIG. 6C, the projections 6*a* of the base unit 6 are then bent over so as to fix the cover plate 4 onto the base unit 6 and provide for the actuator assembly 40.

Regarding the male member, as illustrated in FIGS. 7A–7C, a magnet 11 mounted on the base ila is inserted into an opening 10*b* within the protruding portion 10 and the protruding portion 10 is mounted and fixed onto the mounting prong plate 12.

FIGS. 18A–18B and 19A–19B show detailed views of the protruding portion 10 of the male member including the slot 10*a* which exposes a magnet 11 positioned in the protruding portion 10.

FIGS. 8, 9A–9E, 10A–10C and 11–12 show the assembly of the component parts of the female member as illustrated in FIG. 1.

Figure 9B:
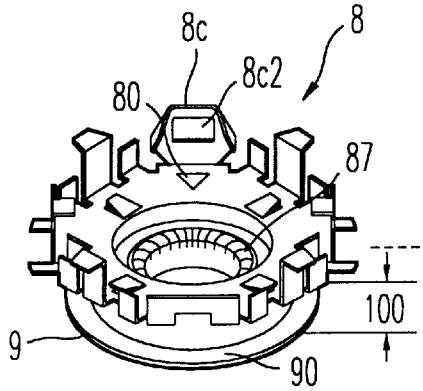
FIGS. 9A–9E are sequential views of the assembly of the actuator assembly and attachment base unit of the present invention.
Figure 9D:
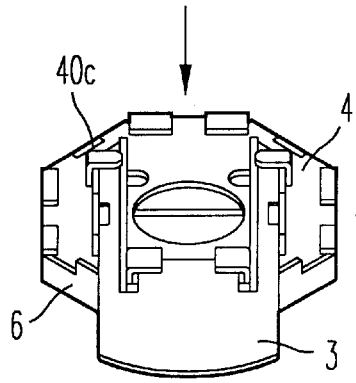
Figure 9A:
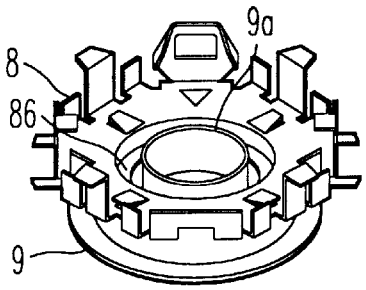
Figure 8:
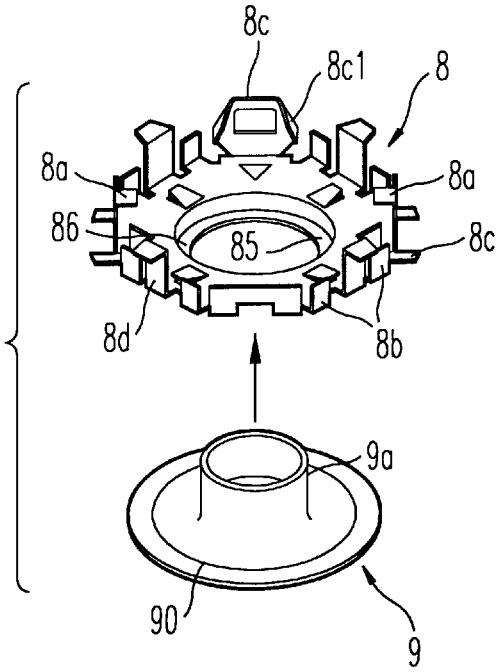
FIG. 8 is an exploded view of the attachment base unit or the attachment grommet of the present invention.

As shown in FIGS. 8 and 9A–9B, the tubular extension 9*a* of the attachment part or grommet 9 is inserted through the opening 85 of the attachment base unit 8 (FIG. 9A). The top portion of the tubular extension 9*a* of the attachment grommet 9 is then bent over onto a recessed inner circumference 86 of the hole 85 of the attachment base unit 8 as illustrated in FIGS. 9A and 9B which shows the bent over top portion of the tubular extension 9*a*. This bent over top portion is identified by reference numeral 87 in FIG. 9B. This arrangement minimizes the vertical size of the assembly.

This procedure permits the attachment of the attachment grommet 9 onto the attachment base unit 8. This specific arrangement also provides a flexibility with respect to the fastening of the female member onto a material. That is, when the female member is to be attached to a material such as leather or cloth, this material is fitted between the attachment grommet 9 and the attachment base unit 8. Due to the tubular extension 9*a*, materials of various thicknesses can be fitted within the space 100 (FIG. 9B) between the base 90 of the attachment grommet 9 and the lower part of the attachment base unit 8. Also, the teeth 80 will extend into the material to help hold the material in place. This arrangement provides added flexibility in that the female member can be fitted onto materials of various thicknesses by simply adjusting the length or the amount of bending of the tubular extension 9*a*.

FIGS. 15A–15C and 16–17 provide detailed views of the attachment part or grommet 9 including the tubular extension 9*a* as well as the process of bending over the top edge of the tubular extension 9*a* so as to attach the attachment grommet 9 to the attachment base unit 8.

Figure 9C:
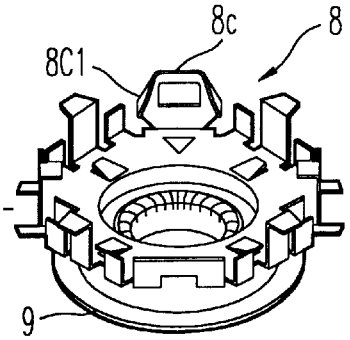
Figure 9E:
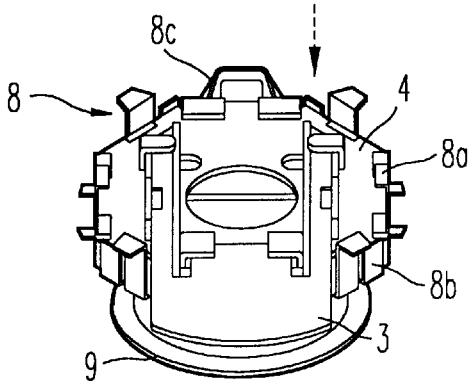

The mounting of the actuator assembly 400 onto the base unit 8 is illustrated in FIGS. 9C–9E and the suggested sequence of assembly is shown by the arrows in the figures. As illustrated in these figures, the actuator assembly 400 illustrated in FIG. 9D is mounted onto the attachment base unit 8 as shown in the manner illustrated in FIG. 9E. Once mounted on the attachment base unit 8, selected ones of the projecting members such as 8*a* and 8*b* and the upwardly extending notch 801 can serve to hold the assembled actuator assembly 400 on the attachment base unit 8. Also, the upwardly biased spring type levers or plates 800 permit the actuator assembly 400 to be firmly held in the attachment base unit 8. The projecting clip portion 8*c* having the folded over portions 8*c*' maximizes the holding of the actuator assembly 400 on the attachment base unit 8 while minimizing the amount of space required for this element to move and maximizing its function.

Figure 10A:
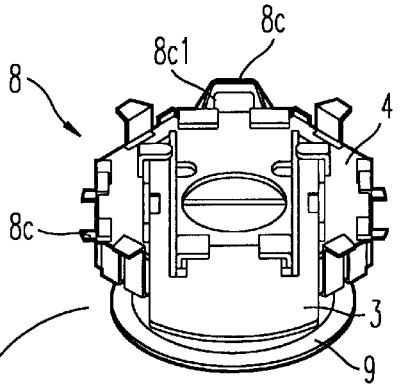
FIGS. 10A–10C are sequential views of a further assembly operation of the present invention.
Figure 14A:
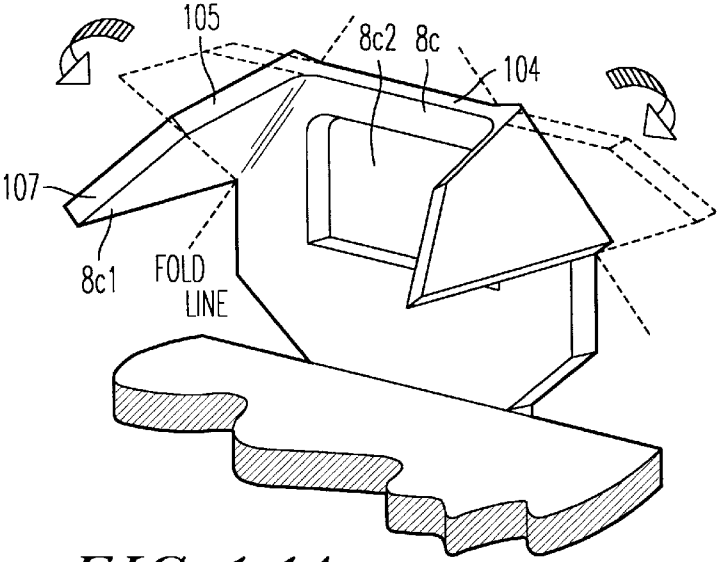
FIG. 14A is an isolated view of a projecting clip portion of the attachment base unit of the present invention.
Figure 14B:
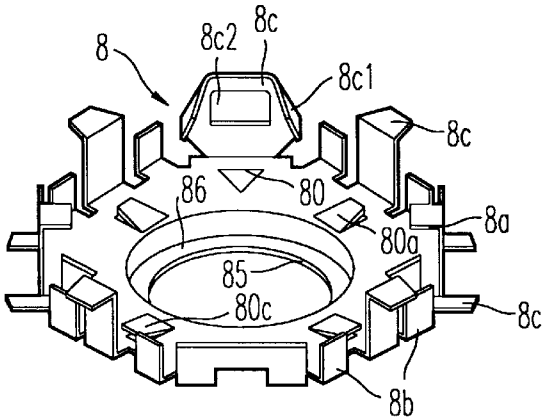
FIG. 14B is a perspective view of the attachment base unit.
Figure 14C:
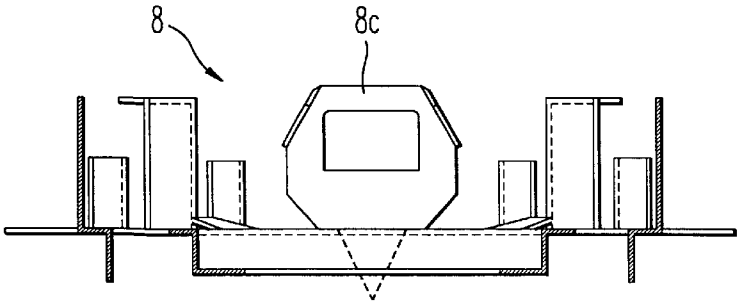
FIG. 14C is a further view of the attachment base unit of the present invention.
Figure 15C:
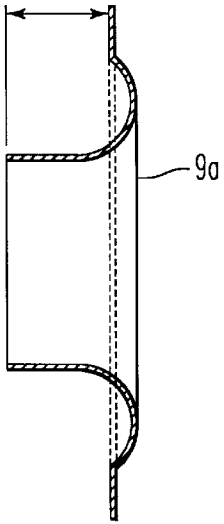
FIGS. 15A–15C are respectively a top view, bottom view and sectional view of the attachment grommet of the present invention.
Figure 15B:
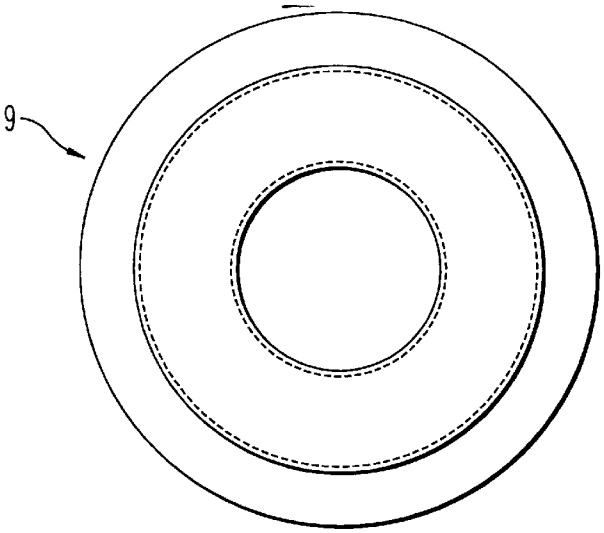
Figure 17:
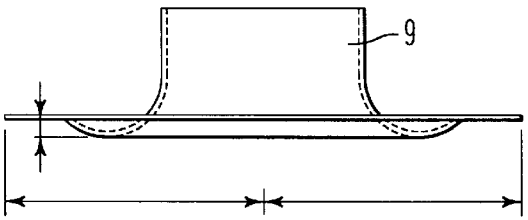
FIG. 17 is a further view of the attachment grommet of FIG. 18.
Figure 15A:
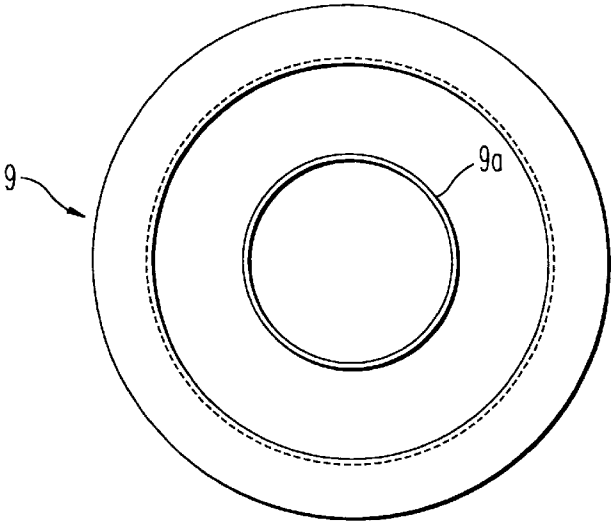
Figure 16:
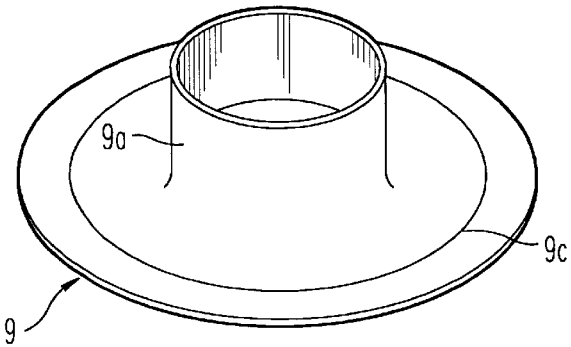
FIG. 16 is a perspective view of the attachment grommet.
Figure 18B:
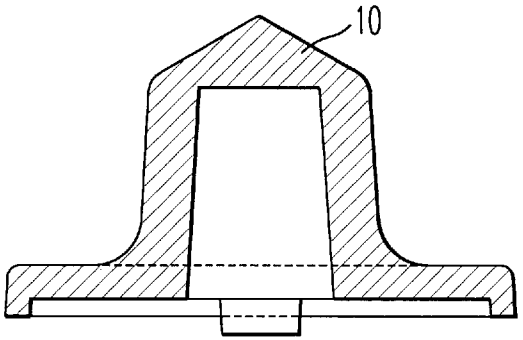
FIGS. 18A–18B are respectively a side view and perspective view of the protruding member of the male member.
Figure 18A:
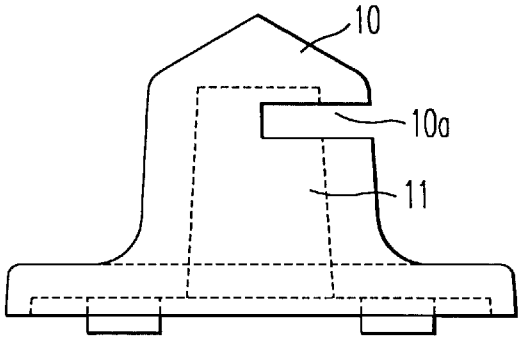
Figure 19B:
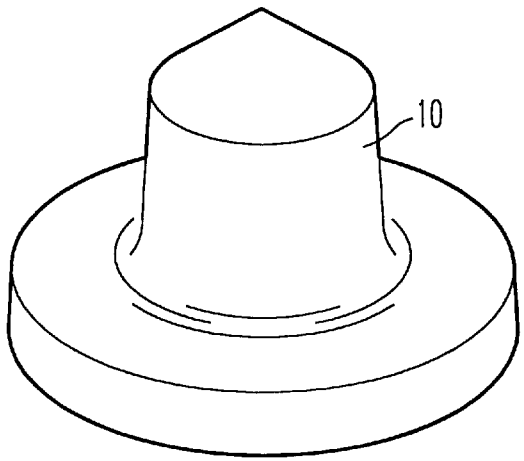
FIGS. 19A–19B are further views of the protruding member of FIGS. 18A–18B.
Figure 19A:
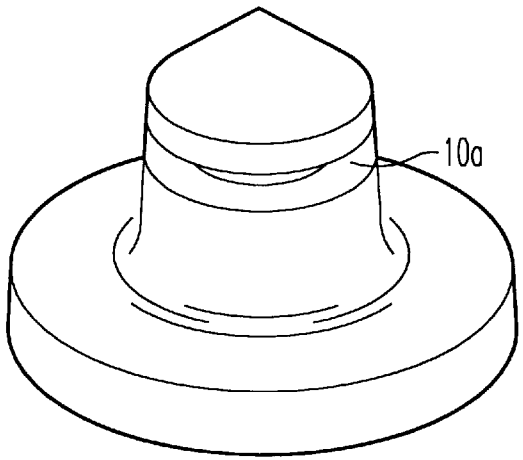

As illustrated in FIG. 10A and 14A, the projecting clip portion 8*c* which includes the folded over portions 8*c*' is attached to the attachment base unit 8 (FIGS. 14A–14C) and includes a first facing surface 104, a second facing surface 105 and a third facing surface 107 which slants at an angle from the second facing surface 105. This arrangement permits an easy insertion of the actuator assembly 400 firmly onto the attachment base unit 8 with a minimum amount of deflection of the elements including the projecting clip portion 8*c*, and at the same time serves to hold the actuator assembly 400 in the attachment base unit 8.

Figure 10B:
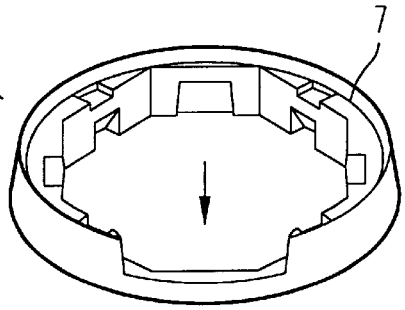
Figure 10C:
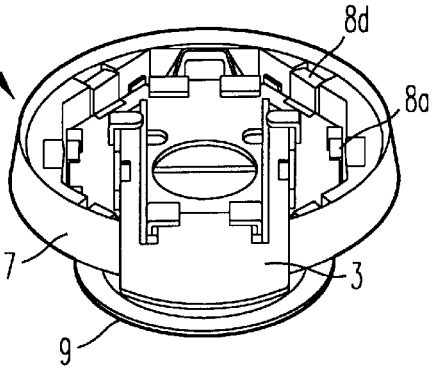

Referring now to FIG. 10A–10C, the actuator assembly 400 mounted on the attachment base unit 8 which has the attachment grommet 9 attached thereto is then fitted with the decorative housing ring 7 as shown by the arrows in the figures. The housing ring 7 is fitted around the outer circumference of the attachment base unit 8 and held thereon by use of the projecting members 8*b* and 8*e*.

Figure 11:
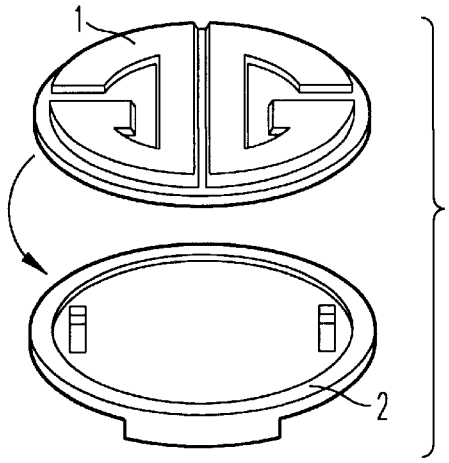
FIG. 11 is an exploded view of a decorative cover member and insert of the present invention.
Figure 12:
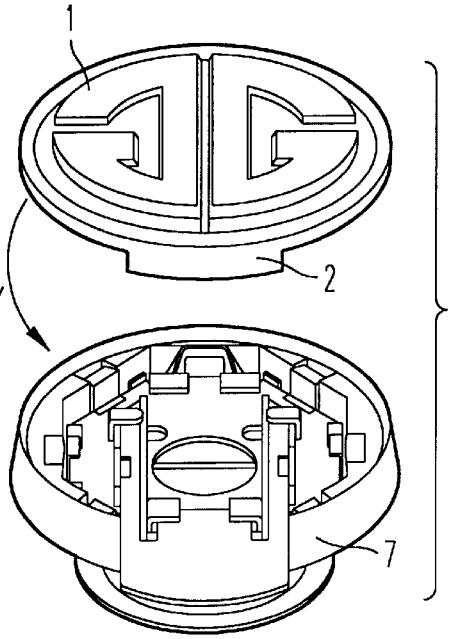
FIG. 12 is an exploded view of the snap lock assembly including the decorative cover member and decorative insert.
Figure 13:
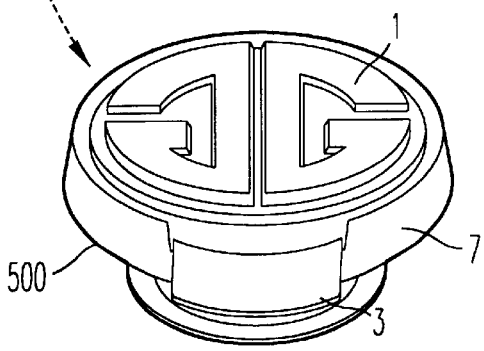
FIG. 13 is a view of the assembled female member of the present invention.

As illustrated in FIGS. 11–13 and shown by the arrows, onto the female member as illustrated in FIG. 10C, a decorative cover 2 having a decorative insert 1 snapped thereon can thereafter be positioned onto the decorative housing ring 7 so as to provide for the completed female assembly 500 (FIG. 13). For example, the projections 8*a* on the attachment base unit 8 can cooperate with slots on the decorative cover 2. Further, as illustrated in FIGS. 24A–24F, the decorative cover 2 can include attachment projections 2*a* which can cooperate with corresponding slots of the housing ring 7. At least one of the attachment projections 2*a* can also be inserted in a hole 802 on the projecting clip portion 8*c*. These are just examples, it is recognized that the cover 2 can have an integral decorative insert, the decorative cover could be glued on the cover 2, or the decorative insert can be a sticker which is placed on the cover 2. It is further recognized that the cover 2 and the housing ring 7 could be a single unit.

With this arrangement, it is possible to attach the snap lock on a handbag and at a later time place a decorative cover on the snap lock.

During use, the male assembly which includes the elements 10, 11, 12 (FIG. 7C) is inserted within an opening defined by the tubular extension 9*a* of the attachment grommet 9 of the assembled female member 500. When the protruding portion 10 having the magnet 11 positioned therein is inserted through the opening of the attachment grommet 9 and extends through the opening 85 of the attachment base unit 8, as well as the aligned openings of the actuator assembly 400, the magnet 11 which is exposed through the opening 10*a* of the protruding portion 10 is attracted to the locking surface 5*b* of the locking slide bar 5. This permits the male member to be locked to the female member.

When it is desired to unlock the male member from the female member, the user actuates, for example, pushes in the actuator 3 of the actuator assembly 400 which causes the actuator assembly 400 including the locking surface 5*b* to be spaced from the opening 10*a* of the protruding portion 10, and thereby away from the magnet 11 positioned within the protruding portion 10. This sliding movement is permitted since the locking slide bar 5 includes the projections 5*a* that extend through the slots 4*b* of the cover plate 4 and are received in the receiving slots 3*a* of the pusher plate 3.

The present invention therefore provides for a compact arrangement that utilizes an attachment base unit 8 onto which the elements of the locking assembly can be easily and securely mounted. This eases the process of assembling the locking unit. Additionally, by use of the tubular extension 9*a* on the attachment grommet 9, the female member is adaptable to materials of various thicknesses.

Therefore, during use, the female member can be mounted onto one flap of, for example, a handbag with the material of the handbag extending between the grommet 9 and the attachment base unit 8. The male member is attached to the body of the handbag by way of the prongs 12*a*. By following the procedure described above, the male member can be releasably locked to the female member.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A magnetic snap lock comprising:

(I) a female member including:

(a) an attachment base unit having a first opening;

(b) an attachment part having a tubular projection which defines a second opening, the tubular projection extending into the first opening of said attachment base unit; and (c) an actuator assembly mounted on said attachment base unit, said attachment base unit comprising first projecting fixing members for fixing said actuator assembly on said attachment base unit; and (II) a male member having a protruding member which is insertable in the second opening of the attachment part.

2. A magnetic snap lock according to claim 1, wherein the tubular projection of the attachment part comprises an upper edge which bends over an inner circumference of the first opening of the attachment base unit so as to attach the attachment part to the attachment base unit.

3. A magnetic snap lock according to claim 1, wherein said actuator assembly comprises:

a housing base;

a locking bar slidably mounted in said housing base, said locking bar comprising projections and a locking surface;

a cover plate mounted on said housing base, said cover plate having slots which correspond to the projections of the locking bar, such that the projections on the locking bar extend into said slots; and an actuator mounted on said cover plate, said actuator having receiving slots for receiving the projections on said locking bar which extend through the slots on said cover plate.

4. A magnetic snap lock according to claim 3, wherein:

said protruding member of said male member has an opening on one side which exposes a magnet positioned within the protruding member, such that an insertion of the protruding member of the male member within the second opening of the attachment part permits a mechanical and magnetic engagement between the male member and the female member when the locking surface of the locking bar magnetically engages with the magnet through the opening in the protruding member, and a movement of the actuator assembly in a first direction causes the locking surface of the locking bar to be spaced from the magnet to permit a disengagement of the male and female members.

5. A magnetic snap lock according to claim 3, wherein said cover plate comprises a plurality of L-shaped projections for holding said actuator on said cover plate.

6. A magnetic snap lock according to claim 1, wherein:

said female member further comprises a housing ring; and said attachment base unit comprises second projecting fixing members for holding the housing ring circumferentially around an outer edge of said attachment base unit.

7. A magnetic snap lock according to claim 5, further comprising a snap-on cover which fits on said housing ring.

8. A magnetic snap lock according to claim 1, wherein said attachment base unit further comprises a projecting base clip portion which comprises a vertical part and first and second radially inwardly extending fold parts for holding the pusher plate assembly on the attachment base unit.

9. A magnetic snap lock according to claim 8, wherein said vertical part comprises at least a first surface portion, and each of said first and second radially inwardly extending fold parts comprise at least a second surface portion which extends at an angle from the first surface portion and a third surface portion which extends at an angle from the second surface portion.

10. A magnetic snap lock according to claim 1, wherein a base of said attachment base part comprises upwardly biased spring type levers.

11. A snap lock comprising:

(I) a female member including:

(a) an attachment base unit having a central opening and a plurality of projections;

(b) an attachment grommet having a tubular extension which extends into said central opening, said tubular extension having an upper portion which is bent onto an inner circumference of said central opening for attaching the attachment grommet to the attachment base unit, wherein a length of the tubular extension and an amount of bending of the upper portion of the tubular extension permits a placement of materials of various thicknesses between the attachment grommet and the attachment base unit; and (c) a locking assembly held on said attachment base unit by said plurality of projections; and (II) a male member comprising fastening means for releasably fastening the male member to the female member.

12. A magnetic snap lock according to claim 11, wherein said attachment base unit comprises teeth which extend into material positioned between the attachment base unit and the attachment grommet.

13. A magnetic snap lock having a spring attachment base unit the attachment base unit comprising:

a base plate having an opening with a recessed circumference;

at least one upwardly biased spring plate positioned on said base plate; and a plurality of projections extending from said base plate wherein said plurality of projections include a projecting base clip, said base clip having a vertical portion and folded portions wherein said folded over portions extend from opposite sides of said vertical portion and wherein said vertical portion comprises a first surface and said folded over portions comprise a second surface which extends from said first surface and a third surface which extends at an angle from said second surface of said projection.

14. A magnetic snap lock according to claim 13, wherein said plurality of projections include:

a notch plate;

a plurality of substantially L-shaped members; and a plurality of straight members.

15. A magnetic snap lock according to claim 14, wherein each of said projecting base clip, said notch plate, said L-shaped members and said straight members are integral with said base plate.

16. A magnetic snap lock having an attachment base unit according to claim 13, wherein said vertical portion comprises a through-hole.

17. An attachment base unit according to claim 13, further comprising teeth members which extend from said base plate.

18. A magnetic snap lock having a spring attachment base, the attachment base unit comprising:

a base plate having an opening with a recessed circumference;

an actuator assembly mounted on said base plate;

at least one upwardly biased spring plate positioned on and integrally formed as part of said base plate and which both holds said actuator assembly on said base plate and holds said actuator assembly in the attachment base unit; and a plurality of projections extending from said base plate wherein said plurality of projections fix said actuator assembly onto said base plate.

19. A magnetic snap lock according to claim 18, which comprises teeth members which extend from said base plate.

20. A magnetic snap lock having a spring attachment base, the attachment base unit comprising:

a base plate having an opening with a recessed circumference;

an actuator assembly mounted on said base plate;

at least one upwardly biased spring plate positioned on said base plate; and a plurality of projections extending from said base plate wherein said plurality of projections fix said actuator assembly onto said base plate and wherein said plurality of projections include:

a projection base clip having folded over portions;

a notch plate;

a plurality of substantially L-shaped members; and a plurality of straight members.

21. A magnetic snap lock according to claim 20, wherein said projection base clip comprises a vertical portion and which comprises folded over portions which extend from opposite sides of said vertical portion.

22. A magnetic snap lock according to claim 20, wherein said vertical portions comprises a first surface, and said folded over portions comprise a second surface which extends from said first surface and a third surface which extends at an angle from said second surface.

23. A magnetic snap lock according to claim 21, wherein said vertical portion comprises a through-hole.

24. A magnetic snap lock according to claim 20, wherein each of said projecting base clip, said notch plate, said L-shaped members, and said straight members are integral with said base plate.

* * * * *